US007147526B1

(12) United States Patent
Chiang

(10) Patent No.: US 7,147,526 B1
(45) Date of Patent: Dec. 12, 2006

(54) SWIM PADDLE

(76) Inventor: Herman Chiang, 11F, No. 634-9, Ching-Ping Rd., Chung-Ho City, Taipei (TW)

( * ) Notice: Subject to any disclaimer, the term of this patent is extended or adjusted under 35 U.S.C. 154(b) by 0 days.

(21) Appl. No.: 11/319,175

(22) Filed: Dec. 28, 2005

(30) Foreign Application Priority Data

Nov. 3, 2005 (TW) ..... 94219030 U

(51) Int. Cl.
*A63B 31/10* (2006.01)

(52) U.S. Cl. ..... 441/58; 441/56

(58) Field of Classification Search ..... 441/55–64; 24/130

See application file for complete search history.

(56) References Cited

U.S. PATENT DOCUMENTS 5,511,998 A * 4/1996 Johnson ..... 441/56
D397,187 S * 8/1998 Reeder ..... D21/807
D439,299 S * 3/2001 Chiang ..... D21/807
6,640,393 B1 * 11/2003 Wendle ..... 24/16 PB

* cited by examiner

*Primary Examiner*—Ed Swinehart
(74) *Attorney, Agent, or Firm*—Troxell Law Office, PLLC

(57) ABSTRACT

A swim paddle has a body portion and at least a strap member mounted on the body portion. The body portion defines a plurality of positioning holes therein. Each positioning hole includes a first passage and a second passage communicating with each other. The first passage has relatively larger width than that of the second passage. A clip neck is formed at a cross of the first passage and the second passage for retaining the strap member. The strap member has a plurality of limbs respectively extending through the positioning holes. Each limb forms tabs thereon which are spaced apart from each other. Each tab has diameter larger than width of second passage. The body portion has a hard center portion and a soft peripheral portion surrounding the hard center portion, thereby protecting the user's wrist and neighboring swimmers.

9 Claims, 6 Drawing Sheets

SWIM PADDLE

BACKGROUND OF THE INVENTION

1. Field of the Invention

The present invention relates to a swim paddle, and particularly to a swim paddle worn on a user's hand for training swimming technique and exercising arm muscles.

2. Related Art

A swim paddle for training swim technique generally comprises a body portion and a strap. A type of body portion has size of appropriately larger than palm area, and another type of body portion has size of appropriately the same as finger area. The two types of body portions respectively define positioning holes for allowing the strap extending therethrough. When the swim paddle is worn, the palm area or the finger area is sandwiched between the body portion and the strap. The strap exerts restriction force on the palm area or the finger area toward the body portion. Users may train swim acts by the swim paddle.

After a period of use, the trap tends to become loose. The strap is fixed to the body portion by the means of a knot larger than the positioning holes. The knot is ordinarily hard to be untied, and therefore is troublesome to adjust the strap.

Additionally, when the swim paddle is used, a user's wrist frequently acts and often hits peripheral of the swim paddle. The swim paddle is made of hard material, and may hurt the user's wrist and affect adversely on his swim training. Moreover, in crowded swim pool, the hard swim paddle may also impacts neighboring swimmers, resulting in undesired incidents.

SUMMARY OF THE INVENTION

Accordingly, an object of the present invention is to provide a swim paddle which has improved assembly of the positioning hole and strap member, adjusting length of the strap member easily.

Another object of the present invention is to provide a swim paddle which is comfortably worn and has soft peripheral portion for avoiding hurting user's wrist and neighboring swimmers.

The swim paddle of the present invention is adapted to be worn on a hand for training hand acts during swimming, and comprises a body portion and at least a strap member mounted on the body portion. The body portion defines a plurality of positioning holes therein. Each positioning hole includes a first passage and a second passage communicating with each other. The first passage has relatively larger width than that of the second passage. A clip neck is formed at a cross of the first passage and the second passage. The strap member has a plurality of limbs respectively extending through the positioning holes. Each limb forms tabs thereon which are spaced apart from each other. Each limb has diameter larger than width of second passage. In assembly, the limbs respectively extend from the first passages and through the clip necks, biasing against the second passages via the tabs, whereby the strap member is positioned and fixed.

The body portion includes a hard center portion and a soft peripheral portion surrounding the center portion. A plurality of support ribs are respectively disposed on left and right sides of the hard center portion and near a wrist in use. A pressing plate is suspended discontinuously from the hard center portion and corresponds to a side of a wrist. The pressing plate is enveloped by the soft peripheral portion and is movable along vertical direction, thereby abating force exerted on the fingers during swimming.

DESCRIPTION OF THE PREFERRED EMBODIMENTS

Figure 1:
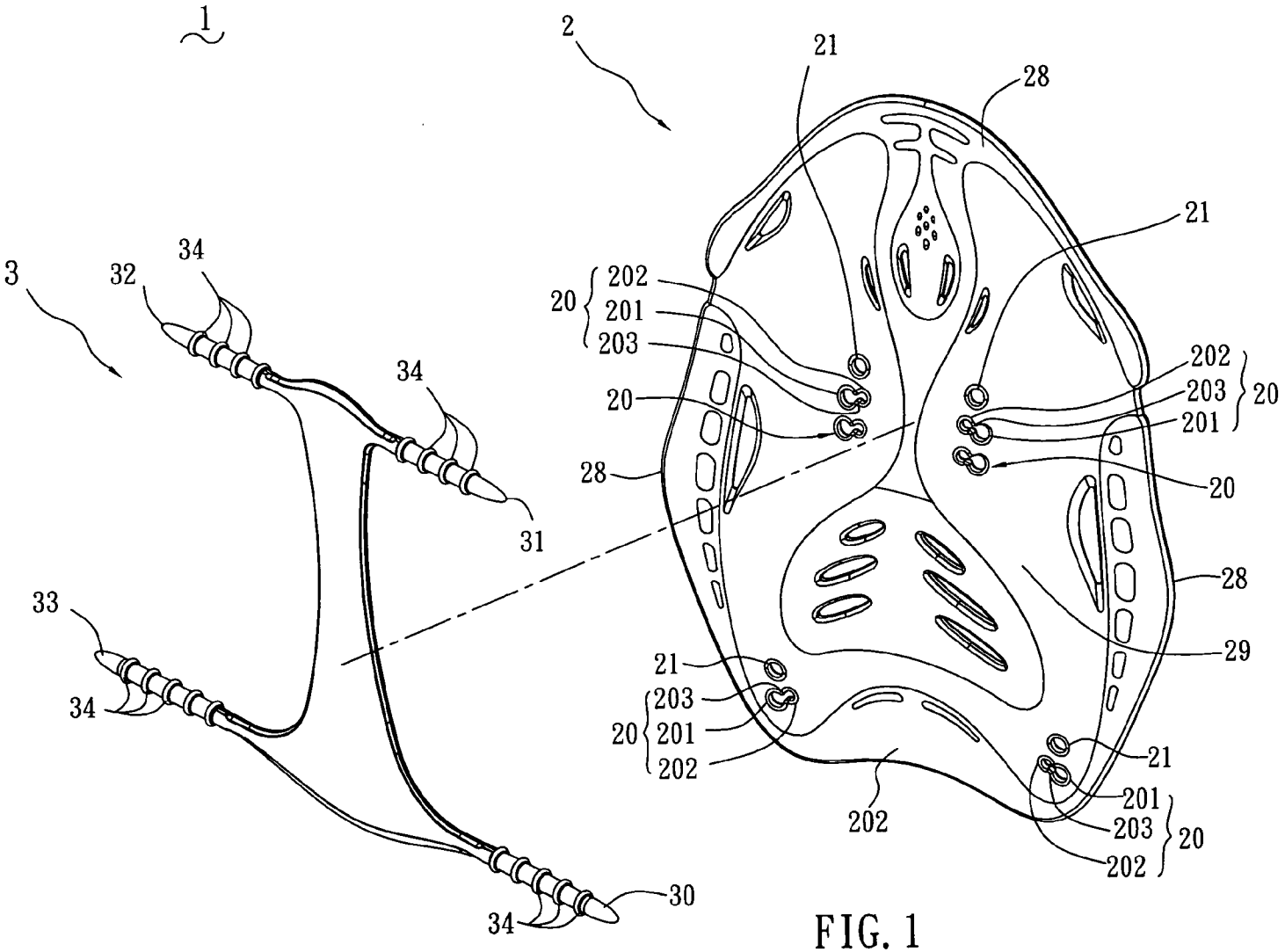
FIG. 1 is an exploded view of a swim paddle according to a first embodiment of the present invention.

With reference to FIG. 1, a swim paddle 1 in accordance with a first embodiment of the present invention comprises a body portion 2 and a strap member 3 mounted on the body portion 2. The body portion 2 is substantially larger than a palm of a hand, and has a hard center portion 29 and a soft peripheral portion 28 surrounding the hard center portion 29. The soft peripheral portion 28 makes user's wrist enjoy comfortable touch and protects neighboring swimmers. Positioning holes 20 are defined in the body portion 2 and are generally oriented as a triangle. Each positioning hole 20 includes a first passage 201 and a second passage 202 communicating with each other. The first passage 201 has relatively larger width than that of the second passage 202. A clip neck 203 is formed at a cross of the first passage 201 and the second passage 202 for clamping the strap member 3. A plurality of couples of positioning holes 20 are arranged in a top of the triangle, so the strap member 3 is selectively secured to either of the couples of positioning holes 20 for fitting to users with different length of fingers. An auxiliary hole 21 is formed proximate the second passage 202 of each positioning hole 20, and has width substantially identical to that of the first passage 201 for retaining the strap member 3.

Figure 2:
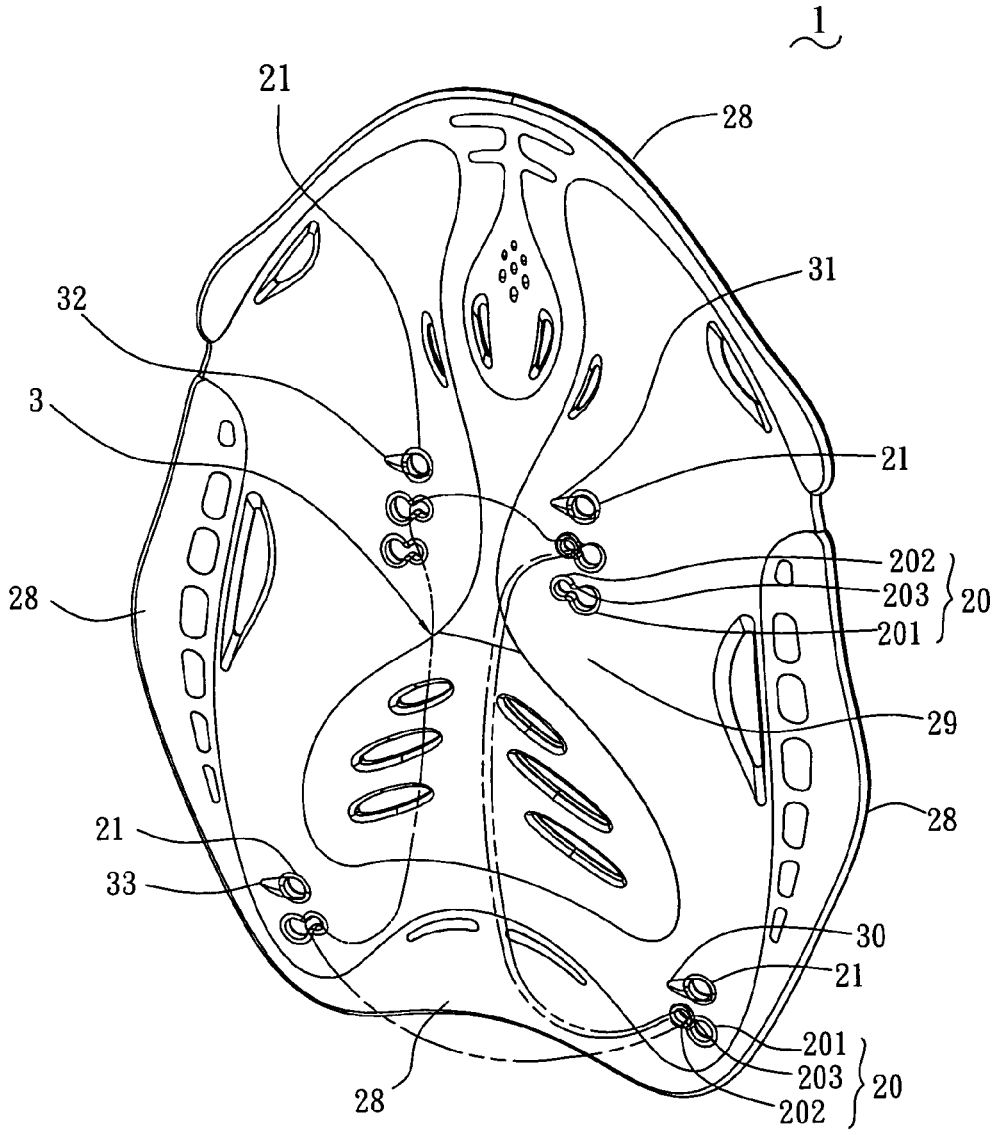
FIG. 2 is an assembled view of the swim paddle of FIG. 1.

In this embodiment the strap member 3 has four limbs 30, 31, 32, 33 respectively extending through the positioning holes 20. Each limb is cylindrical, and forms tabs 34 thereon which are spaced substantially the same distance apart from each other. Each tab 34 has diameter larger than width of second passage 202 and slightly smaller than width of the first passage 201 for positioning and retaining the strap member 3 to the body portion 2. Further referring to FIG. 2, in assembly, the limbs 30, 31, 32, 33 respectively extend from the first passages 201 and through the clip necks 203, biasing against the second passages 202 via the tabs 34. Thus the strap member 3 is positioned and fixed. In the event the limbs 30, 31, 32, 33 have extra length, the limbs 30, 31, 32, 33 extend into the auxiliary holes 21 and are secured thereto. In order to adjust length of the strap member 3, some limbs of the strap member 3 are pulled reversely from the corresponding auxiliary holes 21, and appropriate tabs 34 are chosen to secure the strap member 3 to the body portion 2.

Figure 3:
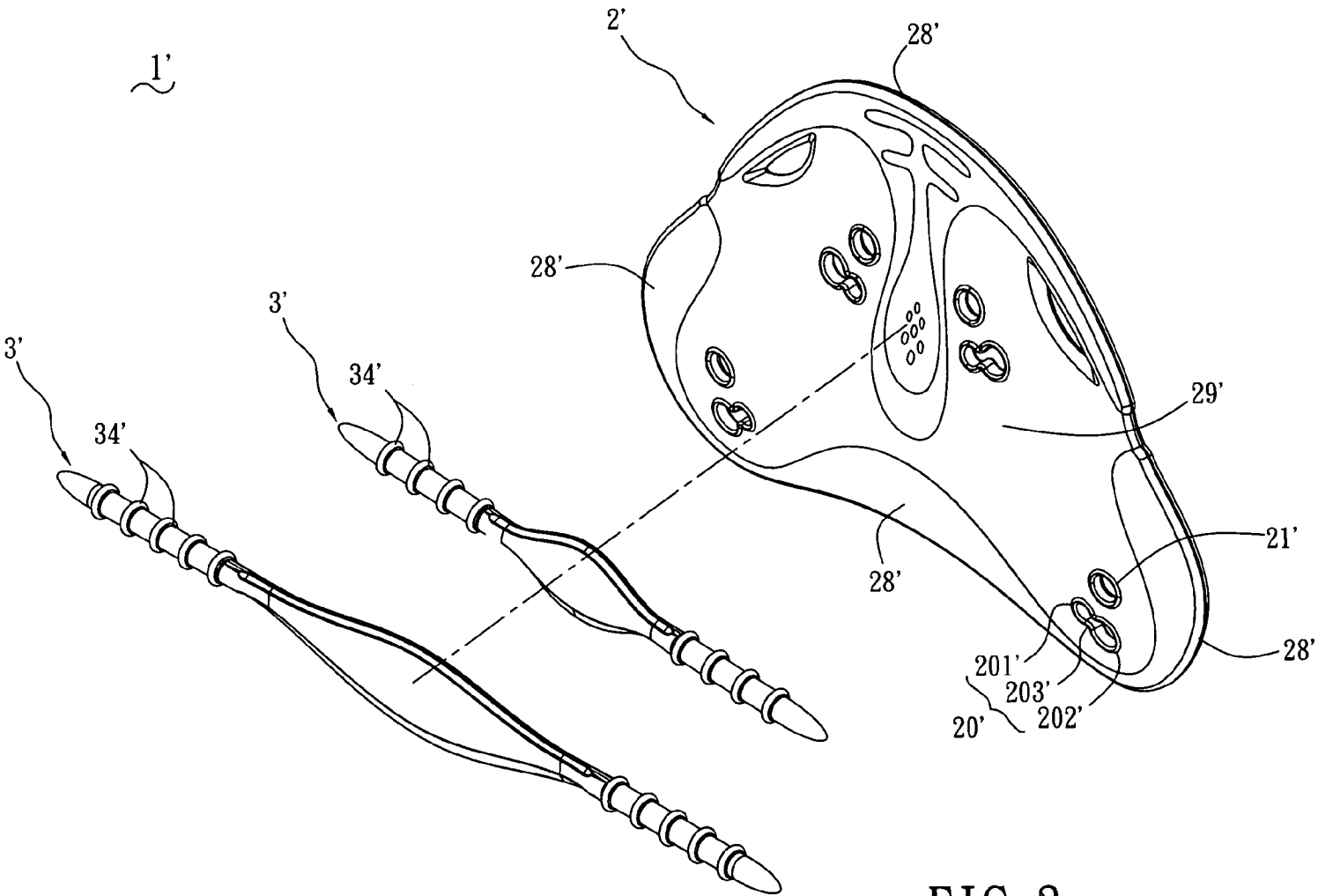
FIG. 3 is an exploded view of a swim paddle according to a second embodiment of the present invention.
Figure 4:
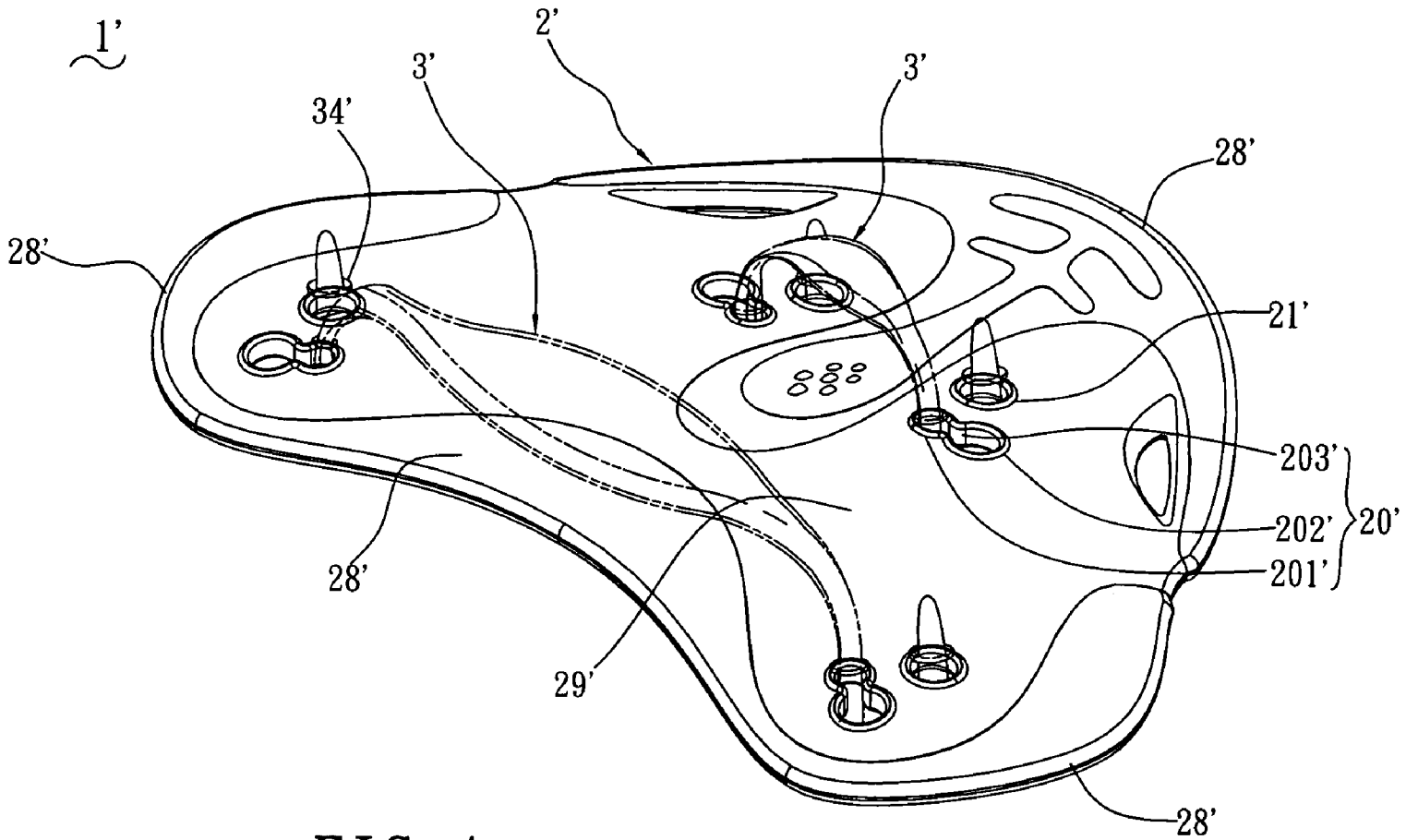
FIG. 4 is an assembled view of the swim paddle of FIG. 3.

FIGS. 3 and 4 show the second embodiment of the instant invention. The swim paddle 1' of the second embodiment still comprises a body portion 2' and two strap members 3'. The swim paddle 1' of the second embodiment is rather similar to the swim paddle 1 of the first embodiment except that the body portion 2' has substantially the same size as that of finger area of a hand and the swim paddle 1' includes two separate strap members 3'. Similar to the swim paddle 1, the body portion 2' of the second embodiment has a hard center portion 29' and a soft peripheral portion 28' surrounding the center portion 29'. Positioning holes 20' are defined in the body portion 2' and are generally oriented as a triangle. Each positioning hole 20' includes a first passage 201' and a second passage 202' communicating with each other. The first passage 201' has relatively larger width than that of the second passage 202'. A clip neck 203' is formed at a cross of the first passage 201' and the second passage 202' for clamping the strap members 3'. An auxiliary hole 21' is formed proximate the second passage 202' of each positioning hole 20'. Each strap member 3' forms tabs 34' with the same functions as the tabs 34 of the first embodiment. The swim paddle 1' is assembled and adjusted in the same way as the swim paddle 1 of the first embodiment.

Figure 7:
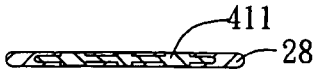
FIG. 7 is a cross-sectional view taken from the line 7—7 in FIG. 5.
Figure 5:
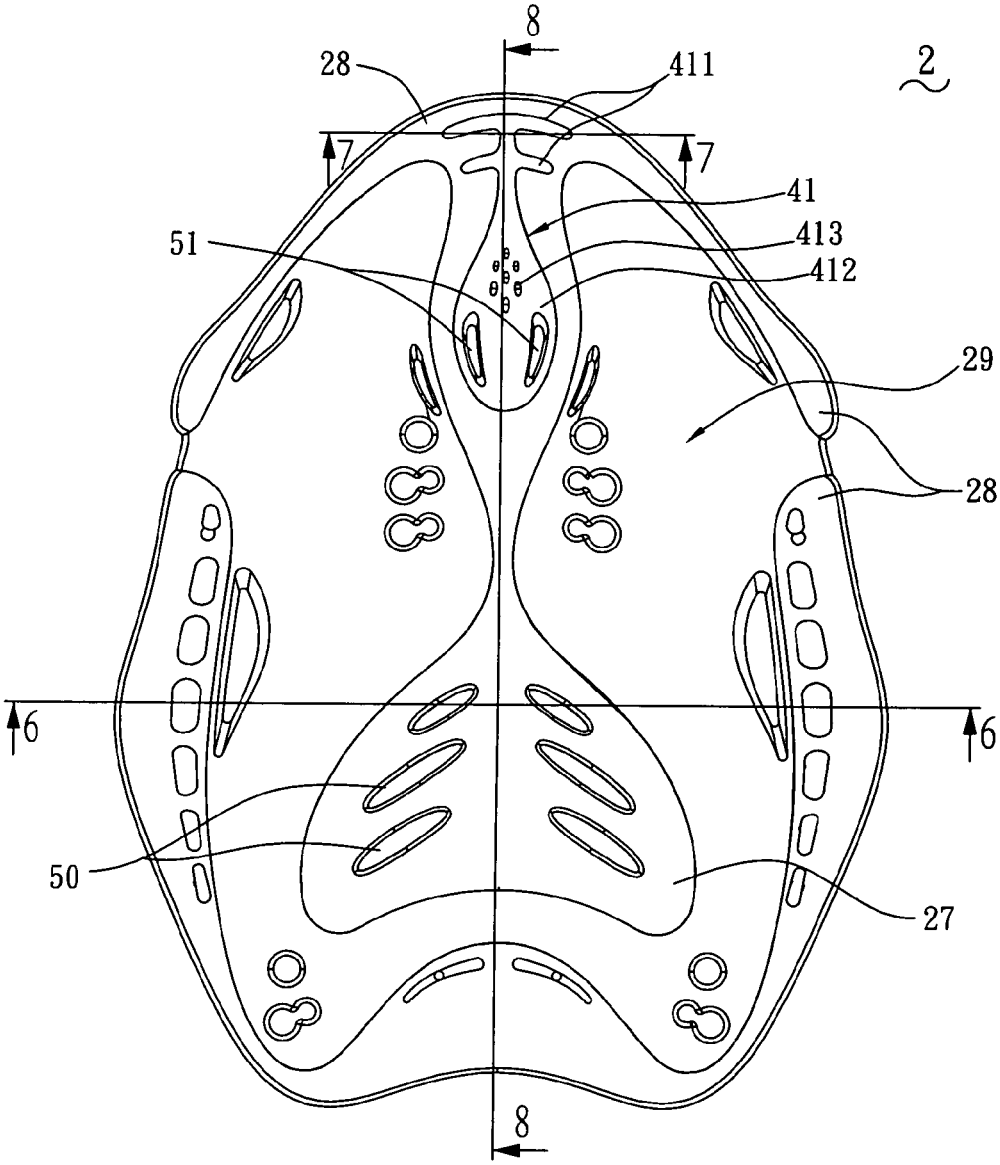
FIG. 5 is a plane view of the swim paddle of FIG. 1.
Figure 6:
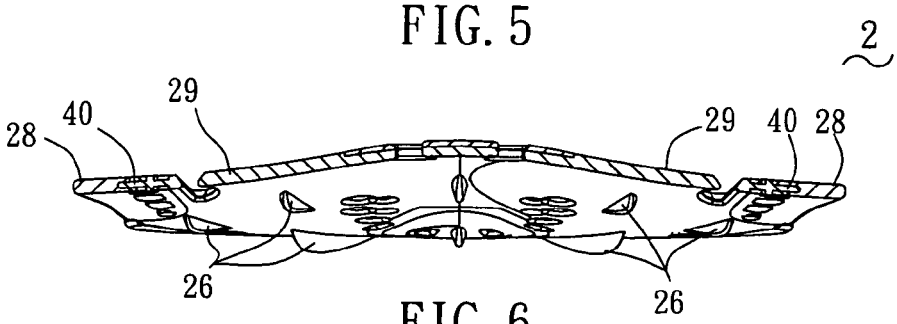
FIG. 6 is a cross-sectional view taken from the line 6—6 in FIG. 5.
Figure 8:
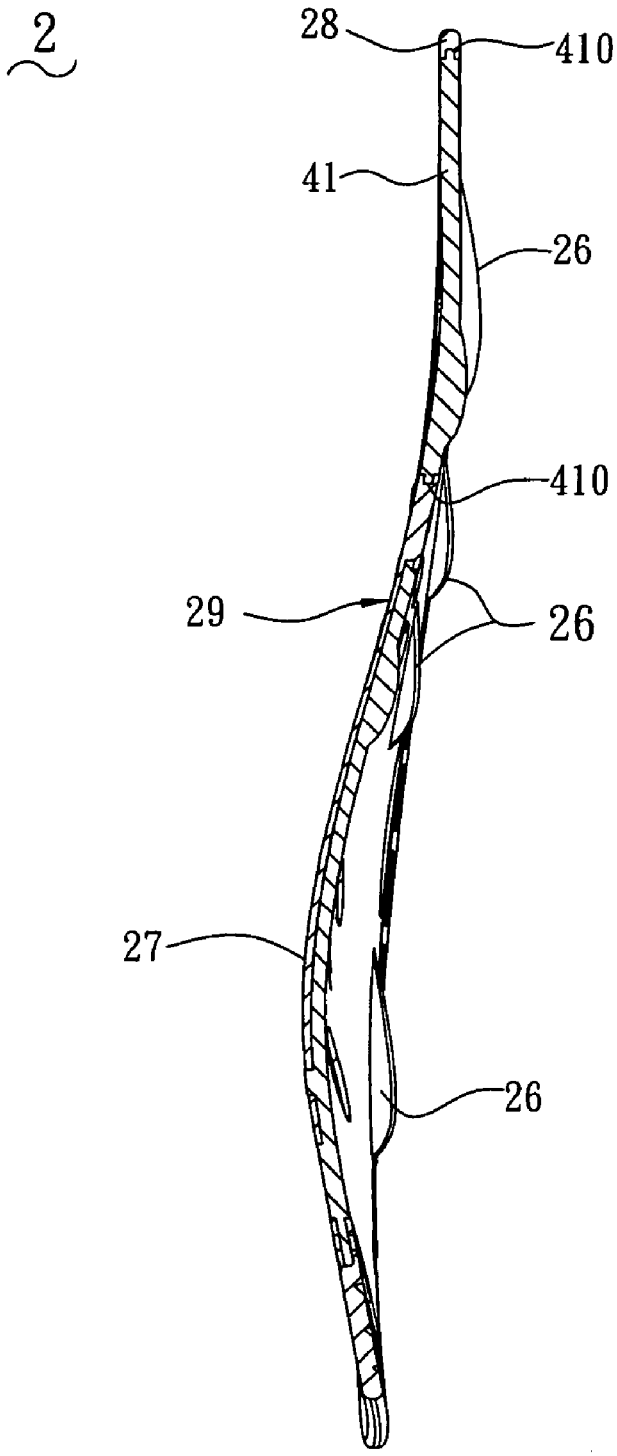
FIG. 8 is a cross-sectional view taken from the line 8—8 in FIG. 5.

Further referring to FIG. 5, the hard center portion 29 and the soft peripheral portion 28 of the body portion 2 are integrally formed. Also referring to FIGS. 6–8, a plurality of support ribs 40 are respectively disposed on left and right sides of the hard center portion 29 and near a wrist (not shown) in use. As shown in FIG. 6, each support rib 40 transversely has cross-like cross section in horizontal and vertical directions, thereby supporting the soft peripheral portion 28 reliably. As shown in FIG. 8, a pressing plate 41 is suspended discontinuously from the hard center portion 29 and corresponds to a side of a wrist. The pressing plate 41 is slightly larger than a middle finger and proximate a middle finger of a user in use. The pressing plate 41 forms projecting edges 410 at a rim thereof for retaining the soft peripheral portion 28. Continuous arcs 411 are formed on an outer portion of the pressing plate 41 for facilitating combination with the soft peripheral portion 28. An arcuate surface 412 slightly projects on an inner portion of the pressing plate 41, and forms a plurality of protuberances 413 thereon for reinforcing friction with a middle finger. The arcuate surface 412 and the protuberances 413 are ergonomic. The continuous arcs 411 transversely form cross-like cross section in horizontal and vertical directions, as shown in FIG. 7. Owing to cross-like cross sections of the projecting edges 410 and the continuous arcs 411, the pressing plate 41 is enveloped by the soft peripheral portion 28 reliably and is movable along vertical direction, thereby abating force exerted on the fingers during swimming. A center plate 27 projects on the body portion 2 for corresponding to center of a palm. The center plate 27 is arcuate and ergonomic. First apertures 50 are defined in the center plate 27, and second apertures 51 are defined in the arcuate surface 412 respectively for facilitating swimming. Disturbing ribs 26 (shown in FIGS. 6 and 8) are formed on the body portion 2 and opposite to the center plate 27 for promoting swimming stability.

It is understood that the invention may be embodied in other forms without departing from the spirit thereof. Thus, the present examples and embodiments are to be considered in all respects as illustrative and not restrictive, and the invention is not to be limited to the details given herein.

I claim:

1. A swim paddle, adapted to be worn on a hand for training hand acts during swimming, comprising:

a body portion defining a plurality of positioning holes therein, each positioning hole including a first passage and a second passage communicating with each other, the first passage having relatively larger width than that of the second passage, a clip neck being formed at a cross of the first passage and the second passage;

at least a strap member mounted on the body portion, the strap member having a plurality of limbs respectively extending through the positioning holes, each limb forming tabs thereon which are spaced apart from each other, each limb having diameter larger than width of second passage, in assembly, the limbs respectively extending from the first passages and through the clip necks, and biasing against the second passages via the tabs, whereby the strap member is positioned and fixed, wherein the body portion includes a hard center portion and a soft peripheral portion surrounding the hard center portion, wherein a plurality of support ribs are respectively disposed on left and right sides of the hard center portion and near a wrist in use, and wherein a pressing plate is suspended discontinuously from the hard center portion and corresponds to a side of a wrist in use, the pressing plate being enveloped by the soft peripheral portion and being movable along vertical direction, thereby abating force exerted on the fingers during swimming, wherein each support rib transversely has cross-like cross section in horizontal and vertical directions.

2. The swim paddle as claimed in claim 1, wherein the body portion forms an arcuate center plate thereon for corresponding to center of a palm in use, and wherein the body portion forms disturbing ribs thereon opposite to the center plate for promoting swimming stability.

3. The swim paddle as claimed in claim 2, wherein the pressing plate is slightly larger than a middle finger and proximate a middle finger of a user in use, and forms projecting edges at a rim thereof for retaining the soft peripheral portion, and wherein continuous arcs are formed on an outer portion of the pressing plate for facilitating combination with the soft peripheral portion, and transversely have cross-like cross section in horizontal and vertical directions.

4. The swim paddle as claimed in claim 3, wherein an arcuate surface slightly projects on an inner portion of the pressing plate, and forms a plurality of protuberances thereon for reinforcing friction with a middle finger.

5. The swim paddle as claimed in claim 4, wherein first apertures are defined in the arcuate center plate and second apertures are defined in the arcuate surface for facilitating swimming, respectively.

6. A swim paddle, adapted to be worn on a hand for training hand acts during swimming, comprising:

a body portion including a hard center portion and a soft peripheral portion surrounding the center portion, a plurality of support ribs being respectively disposed on left and right sides of the hard center portion and near a wrist in use, a plurality of positioning holes being defined in the body portion; and at least a strap member having a plurality of limbs respectively extending through the positioning holes, wherein a pressing plate is suspended discontinuously from the hard center portion and corresponds to a side of a wrist in use, the pressing plate being enveloped by the soft peripheral portion and being movable along vertical direction, thereby abating force exerted on the fingers during swimming.

7. The swim paddle as claimed in claim 6, wherein the pressing plate is slightly larger than a middle finger and proximate a middle finger of a user in use, and forms projecting edges at a rim thereof for retaining the soft peripheral portion, and wherein continuous arcs are formed on an outer portion of the pressing plate for facilitating combination with the soft peripheral portion, and transversely have cross-like cross section in horizontal and vertical directions.

8. The swim paddle as claimed in claim 7, wherein an arcuate surface slightly projects on an inner portion of the pressing plate, and forms a plurality of protuberances thereon for reinforcing friction with a middle finger.

9. A swim paddle, adapted to be worn on a hand for training hand acts during swimming, comprising:

a body portion including a hard center portion and a soft peripheral portion surrounding the center portion, a plurality of support ribs being respectively disposed on left and right sides of the hard center portion and near a wrist in use, a plurality of positioning holes being defined in the body portion; and at least a strap member having a plurality of limbs respectively extending through the positioning holes, wherein each support rib transversely has cross-like cross section in horizontal and vertical directions.

* * * * *